US005856032A

United States Patent [19]

Daub et al.

[11] Patent Number: 5,856,032

[45] **Date of Patent: *Jan. 5, 1999**

[54] CERMET AND PROCESS FOR PRODUCING IT

[75] Inventors: Hans Werner Daub, Köln; Klaus Dreyer, Essen, both of Germany

[73] Assignee: Widia GmbH, Essen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 716,340

[22] PCT Filed: Mar. 29, 1995

[86] PCT No.: PCT/DE95/00434

§ 371 Date: Sep. 30, 1996

§ 102(e) Date: Sep. 30, 1996

[87] PCT Pub. No.: WO95/30030

PCT Pub. Date: Nov. 9, 1995

[30] Foreign Application Priority Data

| | | | |
|---|---|---|---|
| May 3, 1994 | [DE] | Germany | 44 15 454.2 |
| Jul. 5, 1994 | [DE] | Germany | 44 23 451.1 |

[51] Int. Cl.[6] ..... B32B 9/00

[52] U.S. Cl. ..... 428/697; 428/698; 428/699; 428/336; 428/701; 419/25; 419/26; 419/33; 419/54; 419/57; 75/238; 75/242; 75/244

[58] Field of Search ..... 75/238, 242, 244; 428/697, 699, 701, 336, 698; 419/25, 26, 33, 54, 57

[56] References Cited

U.S. PATENT DOCUMENTS

| | | | |
|---|---|---|---|
| 5,308,376 | 5/1994 | Oskarsson | 75/238 |
| 5,336,292 | 8/1994 | Weinl et al. | 75/230 |

FOREIGN PATENT DOCUMENTS

| | | |
|---|---|---|
| 0 368 336 A2 | 5/1990 | European Pat. Off. . |
| 0 515 341 A2 | 11/1992 | European Pat. Off. . |
| 0 591 121 A1 | 4/1994 | European Pat. Off. . |
| 61281835 | 12/1986 | Japan . |
| 62133025 | 6/1987 | Japan . |
| 1152228 | 6/1989 | Japan . |
| WO 94/00612 | 1/1994 | WIPO . |

*Primary Examiner*—Ngoclan Mai
*Attorney, Agent, or Firm*—Herbert Dubno

[57] ABSTRACT

A cermet including a cermet core zone in which the content of a binder amounts to at most 90% by mass in relationship to a cermet hard phase is formed with a 0.01 to 3 um deep surface layer having an increased resistance to wear compare to the cermet core zone.

18 Claims, 1 Drawing Sheet

CERMET AND PROCESS FOR PRODUCING IT

This application is a National Phase application of PCT/DE95/00434 filed 29 Mar. 1995 and based, in turn, on German applications P4415454.2 of 3 May 1994 and P4423451.1 of 5 Jul. 1994 under the International Convention.

Field of the Invention

The invention relates to a cermet with a content of hard materials of 95 to 75% by mass and the balance of 5 to 25% by mass of binder to a process for the production of such a cermet by blending, grinding, granulation and compression of an initial blend of corresponding components and its subsequent sintering.

BACKGROUND OF THE INVENTION

IN EP 0 344 421 A1 a cermet is proposed which has either an average grain size of the hard material phase in the surface layer with respect to a core with a penetration depth of 0.05 mm, which is between 0.8 to 1.2 times the average grain size of the hard material phase in the cermet core, or at the same penetration depth relates to a binder phase which corresponds to 0.7 to 1.2 times the average binder content of the cermet core, or wherein the hardness in the mentioned penetration depth ranges between 0.95 and 1.1 times the average hardness of the cermet core. In order to produce this cermet, the starting mixture is sintered after grinding, blending and precompression, whereby in a first stage the sintering takes place at 1300 degree C or below under vacuum or in an inert gas atmosphere, while in a second stage the sintering takes place above 1300° C. at a nitrogen pressure of 0.1 to 20 torr and whereby the nitrogen pressure is supposed to increase with the increasing temperature. The cooling also takes place in the presence of nitrogen.

The EP 0 368 336 B1 describes a cermet substrate with a hard surface layer, wherein the region with the maximal hardness lies at a depths between 5 $\mu$m and 50 $\mu$m from the substrate surface, and the substrate surface has a hardness of 20 to 90% in relation to the maximal hardness. In order to produce this cermet, the precompressed mixture is subjected to an initial temperature increase up to 1100° C. in vacuum, to a subsequent temperature increase from 1100° C. to a temperature range between 1400° C. and 1500° C. in a nitrogen atmosphere and to a final sintering in vacuum.

The EP 0 374 358 B1 describes a process for the production of a cermet with 7 to 20% by weight binder phase and a hard phase of titanium carbide, titanium nitride and/or titanium carbonitride with 35 to 59% by weight Ti, 9 to 29% by weight W, 0.4 to 3.5% by weight Mo, 4 to 24% by weight of at least one metal among Ta, Nb, V and zirconium, 5.5. to 9,5% by weight $N_2$ and 4.5 to 12% by weight C. The formulated mass, blended, dried and precompressed, is sintered in such a manner that the temperature is increased to 1350° C. in a vacuum, whereby the nitrogen atmosphere is set to 1 torr at 1350° C., the partial nitrogen pressure being gradually increased together with a temperature increase from 1350° C. up to the sintering temperature, whereby the nitrogen atmosphere is set at 5 torr when the sintering temperature is reached.

The EP 0 492 059 A3 describes a cermet body, whose hardness at a penetration depth of no less than 1 mm is higher than in the cermet interior, whereby the binder proportion can be reduced in a layer thickness of 0.5 to 3 $\mu$m when compared to the core substrate. The cermet should have a hard material coating with a thickness of 0.5 to 20 $\mu$m of carbides, nitrides, oxides and borides of titanium and $Al_2O_3$. In order to produce this body, a green compact is preheated at first under vacuum to a temperature between 1100° C. and 1400° C., subsequently nitrogen gas is introduced up to a pressure wherein the partial nitrogen pressure ranges between 5 and 10 torr, so that the nitrogen is removed from the substrate surface. The sintering and the final cooling are performed in a nonoxidizing atmosphere, such as a vacuum or in an atmosphere of inert gas. Finally the body is coated by CVD or PVD.

For the production of a cermet with a high degree of toughness the EP 0 499 223 A1 proposes to set the relative concentration of the binder in layer close to the surface with a thickness of 10 $\mu$m to 5 to 15% of the average content of binder in the cermet core, and in the layer underlying that of 10 $\mu$m to 100 $\mu$m penetration depth to set the binder content to 70 to 100% in relation to the cermet core, whereby compressive strains of 30 kgf/mm$^2$ and more exits at the surface. In the thereby used process the sintering is performed in the presence of nitrogen with a constant pressure of 5 to 30 torr and the cooling takes place under vacuum with a cooling rate of 10° to 20° C. per minute.

On the other hand, the EP 0 515 340 A3 describes a cermet with zone close to the surface enriched with binder.

The EP 0 519 895 A1 discloses a cermet with a triple-layered rim zone, wherein the first layer reaches to a depth of 50 $\mu$m and is rich in TiN, the next layer with a penetration depth of 50 to 150 um is built with a binder enrichment and the next layer between 150 $\mu$m and 400 $\mu$m is poor on binder compared with the inner cermet core. For this purpose the sintered body is treated in an atmosphere of $N_2$ and or $NH_3$, optionally in combination with $CH_4$, CO, $CO_2$ at 1100° C. to 1350° C. during one to 25 hours, at atmospheric pressure or a pressure above 1.1 bar.

The cermets known to the state of the art have either various binder contents at the surface, which can be recognized by their spotty appearance, or have a tendency of attachment of the binder to the sintered substrate, which leads to changes of the composition in the contact zone because of the reactions related thereto. Further disadvantages of the cermets known to the present state of the art are a partially high surface roughness, as well as poor attachment of the applied wear-resistant layers due to the increased binder content in the surface. As far as increased nickel contents appear in the surface, no CVD coating is possible. The mentioned disadvantages show particularly clearly that the cermets can not be used as cutting inserts in machining processes.

OBJECT OF THE INVENTION

It is therefore the object of the invention to improve the cermet mentioned in the introduction by influencing the zones which lie close to the surface in the sense that it becomes more suitable for machining operations, independently of the fact whether they are used uncoated or coated with a single or multiple layer.

This object is achieved due to the cermet defined in according to the invention which is different from the heretofore known cermets in the sense that only in a surface layer defined by a penetration depth of 0.01 to 3 um, measurable by an energy dispersive microanalysis on a measuring area>(0.5×0.5)mm2, the content of Co and/or Ni binder in relation to underlying cermet core areas amount to ≦90% by mass, whereby respectively in the cermet core, on the one hand, and in the surface layer on the other hand, an even distribution of the binder metal exists. Aside from the previously defined, extremely thin rim zone, the cermet has a homogeneous structure, which should not exclude the presence of core-rim structures of the hard material phase.

Further according to the invention the 0.01 to 3 $\mu$m thick surface layer has advantageously a binder content of cobalt and/or nickel which in relation to the underlying cermet core is smaller than 30% by mass, while the titanium content ranges between 110 and 130% by weight.

According to a further embodiment of the invention the sum of the contents of tungsten, tantalum as well as some proportion of molybdenum, niobium, vanadium and/or chrome in the mentioned surface layer amounts to 70 to 100% by mass in relation to the underlying cermet core zones.

The core zones underlying the mentioned surface layer have at least in essence a hard material phase with a core-rim structure. In opposition thereto the hard material phase in the surface layer can be exclusively homogeneous, or in some cases it can also partially have the core-rim structure which is established for the core.

According to a further embodiment of the invention, the cermet has a zone immediately under the surface layer up to a depth of 50 um, maximum 60 um, which has a porosity according to IS04505 of $\leqq$A02 and <B02 and in the underlying core <A08 and <B04.

Particularly when the cermet is to be used in cutting operations the further low surface roughnesses $R_T \leqq 6$ $\mu$m or $R_Z \leqq 5$ $\mu$m act advantageously. Preferably the hardness HV30 in the surface layer is constant.

According to still another embodiment the cermet has in the surface layer with a depth of 0.01 and 3 $\mu$m a Co and/or Ni binder content of <90% by mass at a Ti content between 100% and 120% in relation to the core zone and the sum of contents of W, Ta, as well as optionally Mo, Nb, V, Cr amounts to 80 to 100% by mass.

The cermet can have one or more wear protection layers, which consist of titanium carbides or nitrides and/or of $Al_2O_3$, preferably applied by the CVD process.

The described cermet is preferably produced through the process wherein a mixture containing the inventive components is ground, granulated and precompressed, as well as subsequently sintered, preferably in sintering furnaces with graphite heat conductors. After pressing the green compact is heated next up to the melting temperature of the binder phase under vacuum and a pressure $\leqq 10^{-1}$ mbar, subsequently it is further heated up to the sintering temperature ranging between 1450° and 1530° C., where the temperature it kept constant for 0.2 to 2 hours, after which the body is cooled to 1200° C. The last heating, maintaining at a certain temperature and cooling is performed in a gas mixture of $N_2$ and CO with a $N_2(N_2+Co)$ ratio between 0.1 and 0.9, under a pressure alternating by 10% to 80% of the average value, in a period of time between 40 and 240 seconds, preferably 40 to 180 seconds. The $N_2(N_2+CO)$ ratio is determined by the equation $\bar{y}=(16/11\bar{x}-0.12)\pm 10\%$, whereby $\bar{x}=N/(C+N)$ in % by mass in the cermet and $\bar{y}$=% by mass of the ratio of nitrogen to the total amount of nitrogen and carbon monoxide in the gas mixture, and subsequently the finished sintered bodies are cooled under inert gas, such as argon, nitrogen or vacuum atmosphere.

The average pressure is determined through the linear interrelationship $y=(7/10\times+2.5)\pm 10\%$, whereby y is the average pressure (mbar) and x is the binder content in % by mass. This means that for a binder content of 5% by mass a pressure of 6 mbar±0.6 mbar is the average pressure value and at 25% by mass it is a pressure 20 mbar±2 mbar.

The aforedescribed process management is to be understood so that an average pressure value remains constant over the entire course of the heating starting from the melting point of the binder phase, the sintering and the cooling down to 1200° C., however the pressure oscillates periodically about this average pressure value, particularly through a uniform deviation to higher and lower values. The amplitude of the oscillations can be sinusoidal or saw-toothed, or have shapes derived therefrom. In opposition to the pressure treatment known to the state of the art, only the described pressure oscillations result in a thin and even surface layer influencing of the above-mentioned kind.

According to an embodiment variant, the sintered body can be subjected after sintering to hot isostatic compression under argon at temperatures close to the sintering temperature and at pressure above 30 bar. While the body which is not subjected to the subsequent hot isostatic compression shows a considerably lower binder content of less than 30% by mass in the surface layer to a penetration depth of maximum 3 um, the body subsequently subjected to hot isostatic compression has partially higher binder contents, which however still lie below the 90% mass in relation to the binder content in the cermet core.

In a first embodiment variant cermet bodies are subjected only to one sintering.

BRIEF DESCRIPTION OF THE DRAWING

The above and other features, objects and advantages will become readily apparent from the specific descriptions illustrated by the accompanying drawing in which.

SPECIFIC DESCRIPTION

Figure 1:
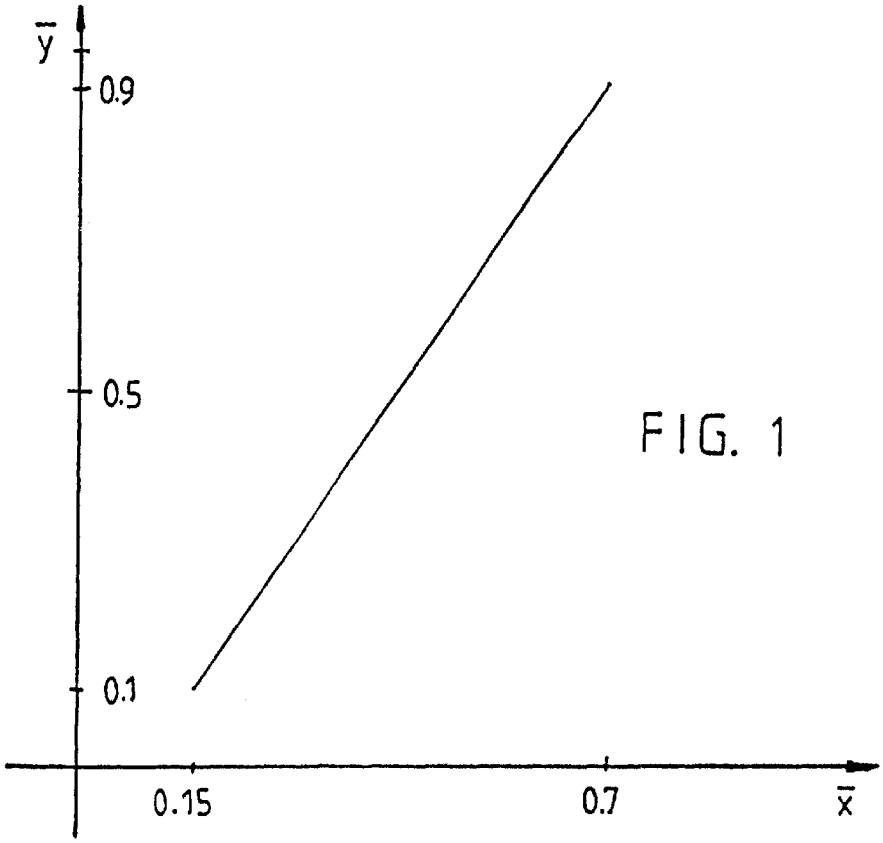
FIG. 1 the linear relation between the ratio N/(C+N) in the cermet and the setting of the ratio $N_2/(N_2+CO)$ in the gas mixture, and FIG. 2 the dependence of the setting of the average pressure on the content of the binder metal in the starting mixture, respectively in the cermet.
Figure 2:
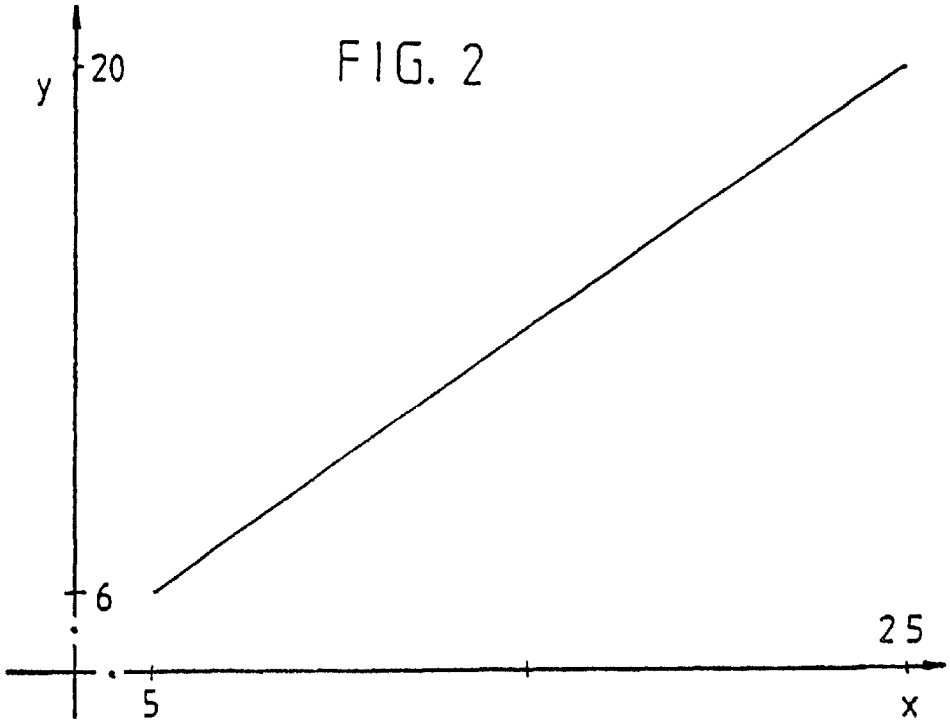

As can be seen from FIG. 1, the respective value $\bar{x}$ represents the relative nitrogen content in the cermet, namely the ratio N/(N+C) and the value $\bar{y}$ the setting of the gas mixture $N2/(N_2+CO)$. The limit values are predetermined by the cermet nitrogen contents between 0.15 and 0.7, to which the setting of the gas mixture of 0.1 and 0.9 are assigned. All values in between can be each derived from the graphic representation, whereby upward or downward oscillations of respectively 10% are acceptable. The same applies to the representation according to FIG. 2, where the ordinate y represents the average pressure in bar and the abscissa the binder content x in % by mass. At a binder content of 25% by mass the average pressure to be set is 20 mbar, at a binder content of 5% by mass it is 6 mbar, whereby here also deviations up to 10% from the average value are acceptable. The pressures set in the sintering furnace oscillate then about a constant average pressure value, namely each time alternately up and down by at least 10%.

In a first embodiment of the invention, the process was started from the following initial mixture (indicated in % by mass):

35.2 TiC 9.0 TaC 15.1 TiN 1.0 NbC 19.2 WC 4.8 Ni 7.1 $Mo_2C$ 8.6 Co

The diameter of the powder particles ranged between 1 to 2 um. From there a nitrogen content of 3.4% by mass and a carbon content of 9.3% by mass result, so that the ratio N/(N+C)=0.27. The total binder content lies at 13.4% by mass. As known to the state of the art, the initial mixture was ground, blended and precompressed. Subsequently the following process steps were taken:

1. Outgrow up to 500° C.
2. Heating from 500° to 1300° C. under vacuum with a heating rate of 400° C/h
3. Heating from 1300° to 1480° C. in a gas mixture of $N_2$ and CO, wherein the ratio $N_2(N_2+CO)=0.27$. After the sintering temperature is reached, the temperature and the subsequently described pressure treatment are kept constant for one hour, after which the sintered body is cooled down from 1480° C. to 1200° C. with a cooling rate of 250° C/h. The heating from 1300° C. to 1480° C., the holding of the temperature, as well as the subsequent cooling have been performed at an average pressure of 10 mbar, whereby the pressure oscillated periodically at a period duration of 150 sec by 3 mbar towards higher or lower values (13 mbar and 7 mbar).
4. The further cooling under argon follows as the last process step.

In a comparative body the same process steps 1, 2 and 4 were performed, but step 3 with the instruction that no CO should be introduced and the set $N_2$ pressure should be kept constant at 20 mbar.

During the analysis of the surface layer after sintering the following values were found:

| Example 1 | invention cermet | comparative cermet |
|---|---|---|
| Ti-(surface layer)/Ti-(core) | 1.3 | 1.4 |
| Binder-(surface layer)/binder (core) | 0.12 | 0.6 |
| Total amount (W,Mo,TA,No) (surface)/ total amount (W,Mo,Ta,Nb) (core) | 0.9 | 0.6 |
| Thickness of rim zone | 0.5 um | 10 um |
| Zone underlying rim zone with a porosity in the core ≦A06 and <B02 and a porosity in the core <A06 and <B02 | 200 um | 250 um |
| roughness depth of the surface | | |
| RT | 5 um | 15 um |
| RZ | 3.8 um | 11 um |

The corresponding analysis of the surface layer after a hot isostatic compression yields the following results:

| Example 2: | invention cermet | comparative cermet |
|---|---|---|
| Ti-(surface layer)/Ti-(core) | 1.23 | 1.00 |
| Binder-(surface layer/binder-(core) | 0.15 | 1.20 |
| Total amount (W,Mo,Ta,Nb) surface/ Total amount (E<Mo,TA,Nb) (core) | 0.98 | 0.8 |
| Porosity throughout ≦A02 and <B02 | | |
| all other values as in Example 1. | | |

In a further example of the invention the process was started from the following initial mixture (indicated in % by mass):

| | |
|---|---|
| 26.1 TiC | 1.1 NbC |
| 27.1 TiN | 8.2 Ni |
| 20.1 WC | 8.7 Co |
| 8.7 TaC | |

The powder particle diameters ranged between 1 and 2 um. Therefrom results a nitrogen content of 6.1% by mass and a carbon content of 7.2% by mass, so that the ratio N/(N+C)=0.46. The total binder content lies at 16.9% by mass. As known to the state of the art, the initial mixture was ground, blended and precompressed. Subsequently the following process steps were performed:

1. Outgrowth up to 500° C.
2. Heating from 500° up to 1320° C. under vacuum with a heating rate of 400° C./h
3. Heating from 1320° up to 1480° C. under a gas mixture of $N_2$ and CO, wherein the ratio $N_2/(N_2+CO)=0.54$. After the sintering temperature is reached, the temperature and the subsequently described pressure treatment were maintained for one hour, after which the sintered body was cooled down from 1480° C. to 1200° C. with a cooling rate of 250° C./h. The heating from 1320° C. to 1480° C., the holding of the temperature, as well as the subsequent cooling were performed at an average pressure of 15 mbar, whereby the pressure oscillated periodically with a period duration of 120 sec by 5 mbar towards higher and lower values (20 mbar and 10 mbar).
4. As a last process step followed the further cooling under argon.

A comparative body was subjected to the same process steps 1, 2 and 4, however the process step 3 was performed according to the instruction not to introduce any CO and the $N_2$ pressure to be kept constant at 20 mbar.

At the analysis of the surface layer after sintering the following values were found:

| Example 3: | invention cermet | comparative cermet |
|---|---|---|
| Ti-(surface layer)/Ti-(core) | 1.23 | 1.00 |
| Binder-(surface layer)/binder-(core) | 0.27 | 0.50 |
| Total amount (W,Ta,Nb,) (surface)/ Total amount (W,Ta,Nb) (core) | 0.82 | 1.5 |
| Thickness of rim zone | 0.3 um | 5 um |
| Zone underlying the rim zone with a porosity ≦A02 and <B02 | 100 um | 120 um |
| Porosity in the core <A08 and <B02 | | |
| Roughness depth | | |
| RT | 3.5 um | 13 um |
| RZ | 2.8 um | 9 um |

The corresponding analyses of the surface layer after one hot isostatic compression yielded the following results:

| Example 4: | invention cermet | comparative cermet |
|---|---|---|
| Ti-(surface layer)/Ti-(core) | 1.21 | 1.00 |
| Binder-(surface layer)/binder-(core) | 0.69 | 1.60 |
| Total amount (W,Ta,Nb) surface/ total amount (W,Ta,Nb) core | 0.78 | 0.4 |
| Porosity throughout ≦A02 and B<02 | | |
| all other values as in Example 3 | | |

The cermets produced according to the above Examples have been subjected to the following machining tests:

Turning in smooth cut, dry

Workpiece material: 42 CrMo4V

Shape of indexable inserts: CnMG 120408-22

Cutting edge rounding: 30–50 um

Cutting conditions:
Cutting speed $V_c$=140 m/min
Cutting depth $a_p$=2 mm
Advance f=0.3 mm

| Example | Edge life (min) invention cermet | Edge life (min) comparative cermet |
|---|---|---|
| 1 | 16 | 5 |
| 2 | 18 | 9 |
| 3 | 25 | 12 |
| 4 | 32 | 13 |

Cutting time criterium: Plastic deformation

We claim:

1. A cermet comprising:

a cermet core zone formed with:

at least one hard material phase of 95% to 75% by mass including carbonitrides of a cubic B1 crystalline structure and containing 30 to 60% by mass Ti, 5 to 25% by mass W, 5 to 15% by mass Ta of which up to 70% by mass can be replaced by Nb, 0 to 12% by mass Mo, 0 to 15% by mass V, 0 to 2% by mass Cr, 0 to 1% by mass Hf and Zr, the (C+N) content being excess of 80 mol % and the nitrogen content N/(C+N) ratio ranging between 0.15 and 0.7, and a binder phase of 5% to 25% by mass of at least one metal selected from the group consisting of Co and Ni and containing at most 2% by mass Al, and at least one member of the group consisting of metallic W, Ti, Mo, V and Cr dissolved in the metal; and a surface layer above the core zone defined by a penetration depth of 0.01 to 3 $\mu$m and measurable through an energy dispersive microanalysis on a measuring surface >(0.5×0.5)mm$^2$, said surface layer being formed with:

a surface binder from the group consisting of Co and Ni and amounting to at most 30% by mass in relation to the underlying cermet core zone, and a Ti content amounting to 110 to 130% in relation to the Ti content of the underlying cermet core zone, and wherein the cermet core and in the surface layer, respectively, there are even distributions of the binder, and the sum of the contents of W, Ta, Mo, Nb, V and Cr in the surface layer over a thickness of 0.01 to 3 $\mu$m amounts to 70 to 100% by mass in relation to the sum of said contents of the underlying cermet core zone.

2. The cermet defined in claim 1 wherein said zone core has a core-rim structure.

3. The cermet defined in claim 1 wherein said surface layer is further formed with a respective homogeneous hard material phase.

4. The cermet defined in claim 1 wherein said core zone is formed with a subsurface zone immediately under the surface layer down to a depth between 50 and 600 $\mu$m and having a porosity ≦A02 and <B02 and <A08 and <B04 in the underlying core zone according to ISO 4505.

5. The cermet defined in claim 4 wherein said porosity <A02 and <B02 is uniform through all of the layers.

6. The cermet defined in claim 4 wherein said surface layer has roughness equaling $R_T$≦6 $\mu$m or $R_Z$≦5 $\mu$m.

7. The cermet defined in claim 4 wherein the surface layer has a constant hardness of HV 30.

8. A process for forming a cermet comprising the steps of:

(a) blending, grinding, granulating and compressing an initial mixture for forming a cermet core comprising:

a binder phase of 5% to 25% by mass of at most 2% by mass Al, and a group consisting of metallic W, Ti, Mo, V and Cr, and a hard material phase of 95% to 75% by mass including carbonitrides of a cubic B1 crystalline structure and containing 30 to 60% by mass Ti, 5 to 25% by mass W, 5 to 15% by mass Ta, of which up to 70% by mass can be replaced by Nb, 0 to 12% by mass Mo, 0 to 15% by mass V, 0 to 2% by mass Cr, 0 to 1% by mass Hf and Zr, the (C+N) content in excess of 80 mol % and the nitrogen content N/(C+N) ratio ranging between 0.15 and 0.7

(b) thereafter sintering the cermet core in a sintering furnace with graphite heat conductors by:

($b_1$) heating the cermet core up to the melting point of the binder phase under vacuum with a pressure of ≦$10^{-1}$ mbar, ($b_2$) thereafter heating the cermet core up to the sintering temperature and holding the sintering temperature for 0.2–2 hours, and ($b_3$) subsequently cooling down to 1200° C.;

(c) repeating steps ($b_1$)–($b_3$) in a gas mixture of $N_2$ and CO with a $N_2/(N_2+CO)$ ratio between 0.1 and 0.9 under an average pressure alternating by 10% to 80% about the mean pressure in a period of time between 40 and 240 seconds and determined by the linear relation $y=(7/10x+2.5)\pm10\%$, whereby y=the average pressure in (mbar) and x=the binder content in % by mass, and a $N_2/(N_2+CO)$ ratio $\bar{y}$, which is determined by $\bar{y}=(16/11\bar{x}-0.12)+10\%$ with $\bar{x}$=N/(C+N) in the cermet; and (d) thereafter cooling under inert gas from a group consisting of argon and nitrogen or under vacuum.

9. The process defined in claim 8 wherein said step c includes the heating within the melting point range ($T_s$±80° C.) performed at a pressure of 0.2 mbar.

10. The process defined in claim 11 wherein the heating is initially performed in a vacuum of at least 0.1 mbar to 1020° C. and thereafter, upon introducing Ni at a pressure of 0.2 mbar, to 1370° C.

11. The process defined in claim 8, further comprising a post-sintering step of a hot isostatic compression under argon at temperatures close to the sintering temperature and pressure above 30 bar.

12. A cermet comprising:

a cermet core zone formed with:

at least one hard material phase of 95% to 75% by mass of a cubic B1 crystalline structure of 30 to 60% by mass Ti, 5 to 25% by mass W, 5 to 15% by mass Ta of which up to 70% by mass can be replaced by Nb, 0 to 12% by mass Mo, 0 to 5% by mass V , 0 to 2% by mass Cr, 0 to 1% by mass Hf and Zr, the (C+N) content being excess of 80 mol % and the nitrogen content N/(C+N) ratio ranging between 0.15 and 0.7, and a binder phase of 5% to 25% by mass of at least one metal selected from the group consisting of Co and Ni and containing at most 2% by mass Al, and at least one member of the group consisting of metallic W, Ti, Mo, V and Cr dissolved in the metal; and a surface layer above the core zone defined by a penetration depth of 0.01 to 3 $\mu$m and measurable through an energy dispersive microanalysis on a measuring surface >(0.5×0.5)mm$^2$, said surface layer being formed with:

a surface binder from the group consisting of Co and Ni and amounting to <90% by mass in relation to the underlying cermet core zone, and a Ti content amounting to 100 to 120% in relation to the Ti content of the underlying cermet core zone, and wherein the cermet core and in the surface layer, respectively, there are even distributions of the binder, and the sum of the contents of W, Ta, Mo, Nb, V and Cr in the surface layer over a thickness of 0.01 to 3 $\mu$m amounts to 80 to 100% by mass in relation to the sum of said contents of the underlying cermet core zone.

13. The cermet defined in claim 12 wherein said zone core has a core-rim structure.

14. The cermet defined in claim 12 wherein said surface layer is further formed with a respective homogeneous hard material phase.

15. The cermet defined in claim 12 wherein said core zone is formed with a subsurface zone immediately under the surface layer down to a depth between 50 and 600 $\mu$m and having a porosity ≦A02 and <B02 and <A08 and <B04 in the underlying core zone according to ISO 4505.

16. The cermet defined in claim 15 wherein said porosity <A02 and <B02 is uniform through all of the layers.

17. The cermet defined in claim 12 wherein said surface layer has roughness equaling $R_T \leqq 6$ $\mu$m or $R_Z \leqq 5$ $\mu$m.

18. The cermet defined in claim 12 wherein the surface layer has a constant hardness of HV 30.

* * * * *